US006669282B2

(12) United States Patent
Piretti

(10) Patent No.: US 6,669,282 B2
(45) Date of Patent: Dec. 30, 2003

(54) CHAIR WITH WRITING TABLE

(75) Inventor: Giancarlo Piretti, Bologna (IT)

(73) Assignee: Pro-Cord SpA (IT)

( * ) Notice: Subject to any disclaimer, the term of this patent is extended or adjusted under 35 U.S.C. 154(b) by 0 days.

(21) Appl. No.: 10/159,179

(22) Filed: May 30, 2002

(65) Prior Publication Data

US 2002/0190546 A1 Dec. 19, 2002

(30) Foreign Application Priority Data

Jun. 15, 2001 (IT) ..... T02001A0576

(51) Int. Cl.[7] ..... A47B 39/00
(52) U.S. Cl. ..... 297/162; 297/239; 297/173
(58) Field of Search ..... 297/160, 161, 297/162, 173, 155, 154, 164, 174 R, 232, 234, 239, 240, 243, 257; 108/53.3, 91, 92

(56) References Cited

U.S. PATENT DOCUMENTS

| | | | | | |
|---|---|---|---|---|---|
| D153,909 | S | * | 5/1949 | Wais | D6/483 |
| 2,954,073 | A | | 9/1960 | Junkunc | |
| 2,970,635 | A | * | 2/1961 | Fields | 297/239 |
| 3,156,498 | A | * | 11/1964 | Blodee | 297/162 |
| 3,479,084 | A | * | 11/1969 | Ryn | 297/162 |
| 3,497,262 | A | * | 2/1970 | Piretti et al. | 297/239 |
| 3,712,668 | A | * | 1/1973 | Fink | 297/162 |
| 4,067,606 | A | * | 1/1978 | Desmoulins nee Fouchereau et al. | 297/141 |
| 4,216,994 | A | * | 8/1980 | Benoit | 297/162 |
| 4,944,552 | A | * | 7/1990 | Harris | 297/145 |
| 5,002,337 | A | * | 3/1991 | Engel et al. | 297/239 |
| 5,354,079 | A | * | 10/1994 | Hettenbach | 280/33.991 |
| 5,613,448 | A | * | 3/1997 | Petty | 108/91 |
| 5,683,136 | A | * | 11/1997 | Baumann et al. | 297/162 |
| 5,954,393 | A | * | 9/1999 | Perrin | 297/161 |
| 6,073,997 | A | * | 6/2000 | Koh | 297/173 |
| 6,085,669 | A | * | 7/2000 | Marchand et al. | 108/91 |
| 6,142,566 | A | * | 11/2000 | Ritch et al. | 297/239 |
| 6,224,149 | B1 | * | 5/2001 | Gevaert | 297/162 |

FOREIGN PATENT DOCUMENTS

| | | |
|---|---|---|
| DE | 199 05 001 A1 | 8/1999 |
| EP | 0 995 376 A1 | 4/2000 |

OTHER PUBLICATIONS

EP Search Report dated Jul. 24, 2002 (2 pages).

* cited by examiner

*Primary Examiner*—Peter M. Cuomo
*Assistant Examiner*—Stephanie Harris
(74) *Attorney, Agent, or Firm*—TraskBritt

(57) ABSTRACT

A chair comprising a base structure (22) bearing a seat (32), backrest (36), and a writing table (42) which can be moved between a lowered, inoperative, position, and a raised, operative, position. In the aforesaid lowered, inoperative, position, the table (42) is inclined with respect to a vertical plane (A) parallel to the longitudinal plane of symmetry of the chair, in such a way that two or more chairs of the same type can be set longitudinally against one another, with the tables of two adjacent chairs partially overlapping one another.

6 Claims, 7 Drawing Sheets

20
24
26
28
30
32
34
36
38
40
42
44
46
48
A
α
IX
X
XI
VI

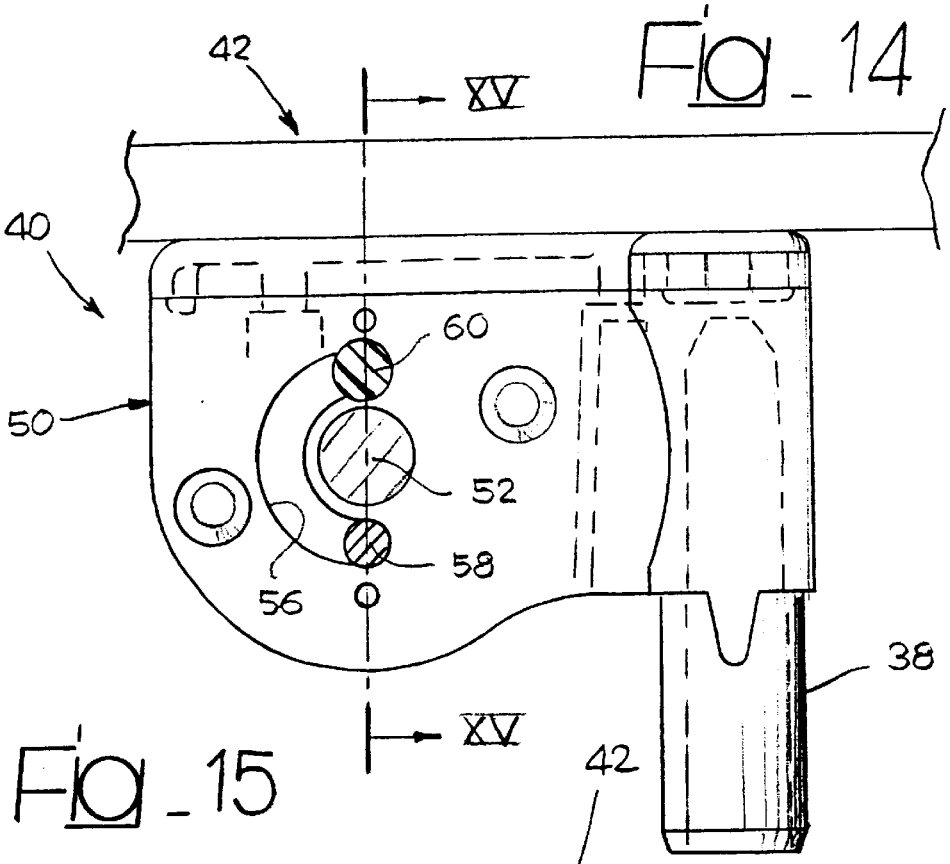
Fig_14
Fig_15
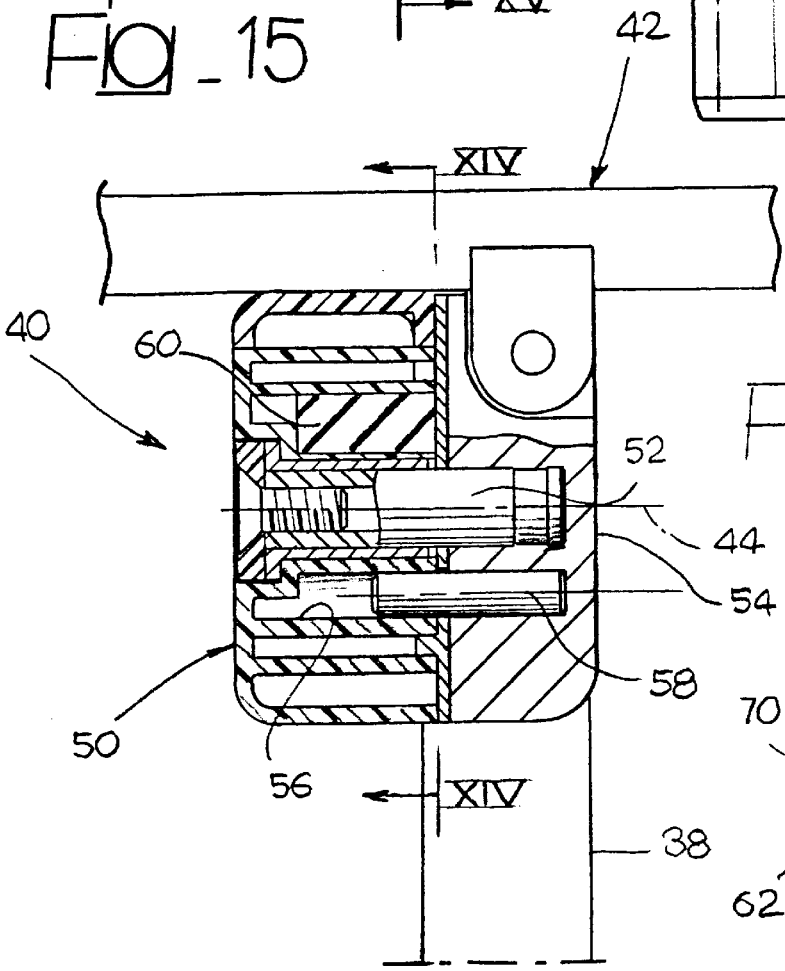
Fig_13
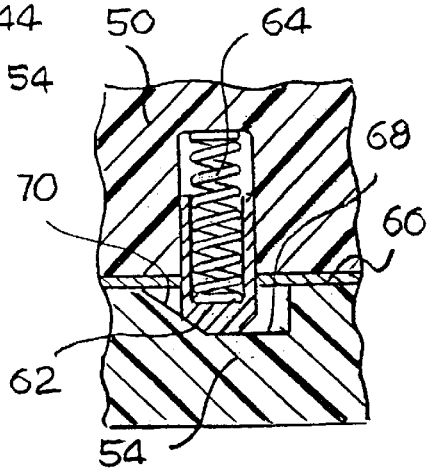

CHAIR WITH WRITING TABLE

The present invention relates to a chair with a writing table. Chairs of the above type are normally used as seating places for people participating at meetings, congresses, lessons, and the like. The writing table is normally mounted in an articulated way on the supporting structure of the chair and can be displaced between a lowered, inoperative, position, and a raised, operative, position, in which it forms a resting surface that enables the occupant to write or work on a portable computer.

One of the requirements that must be met by chairs designed for being used at meetings and the like is the need to enable one chair to slide into another chair so as to occupy as little space as possible when the chairs are stacked away out of use. There are already known chairs for meetings, congresses, and the like without writing tables, which can be set against one another when out of use in a longitudinal direction. The presence of an integral writing table generally makes it impossible for the chairs to slide into one another.

The purpose of the present invention is to provide a chair of an improved type which will enable the above problem to be overcome.

According to the present invention, the above and other purposes are achieved by a chair having the characteristics that form the subject of the ensuing claims.

The present invention will now be described in detail, with reference to the attached drawings, which are provided purely by way of non-limiting example and in which:

FIGS. 12 and 13 are cross sections taken, respectively, along the lines XII—XII and XIII—XIII of FIG. 11;

FIG. 14 is a cross section taken along the line XIV—XIV of FIG. 15;

FIG. 15 is a cross section taken along the line XV—XV of FIG. 14;

Figure 2:
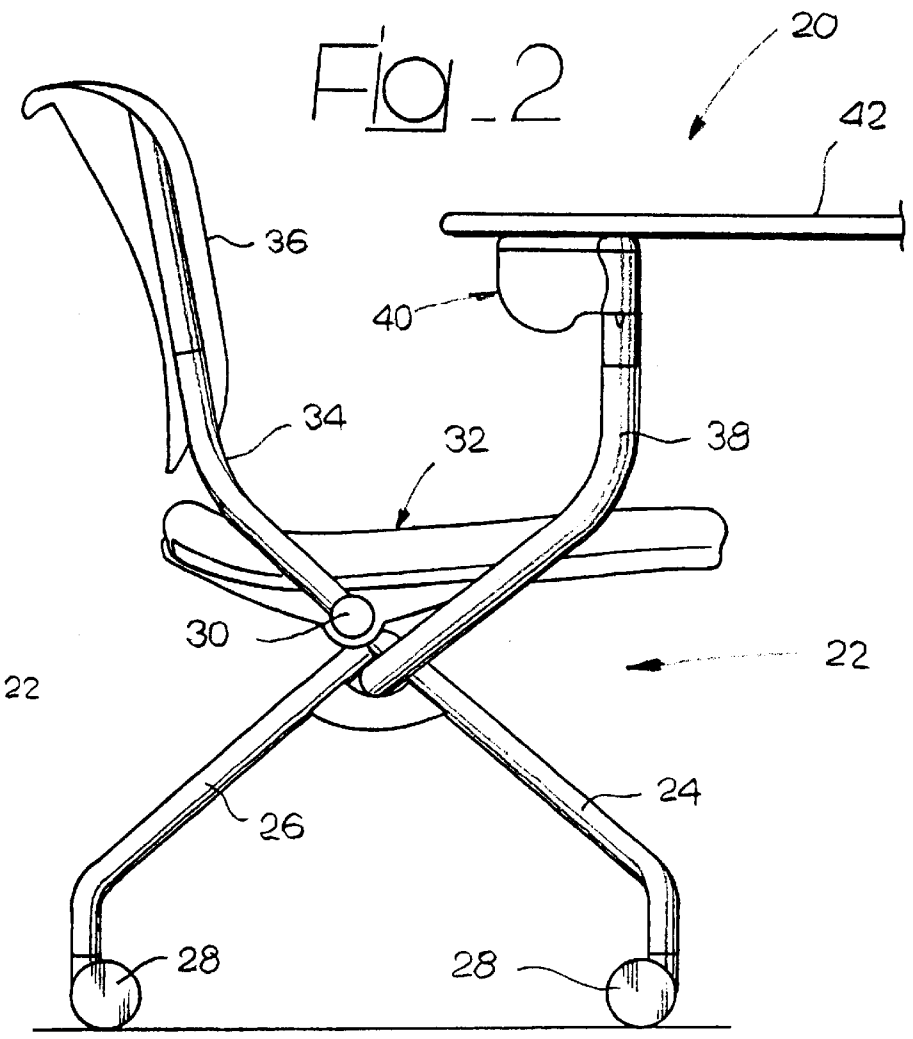
FIG. 2 is a side view of the chair illustrated in FIG. 1, with the writing table in the raised position.
Figure 1:
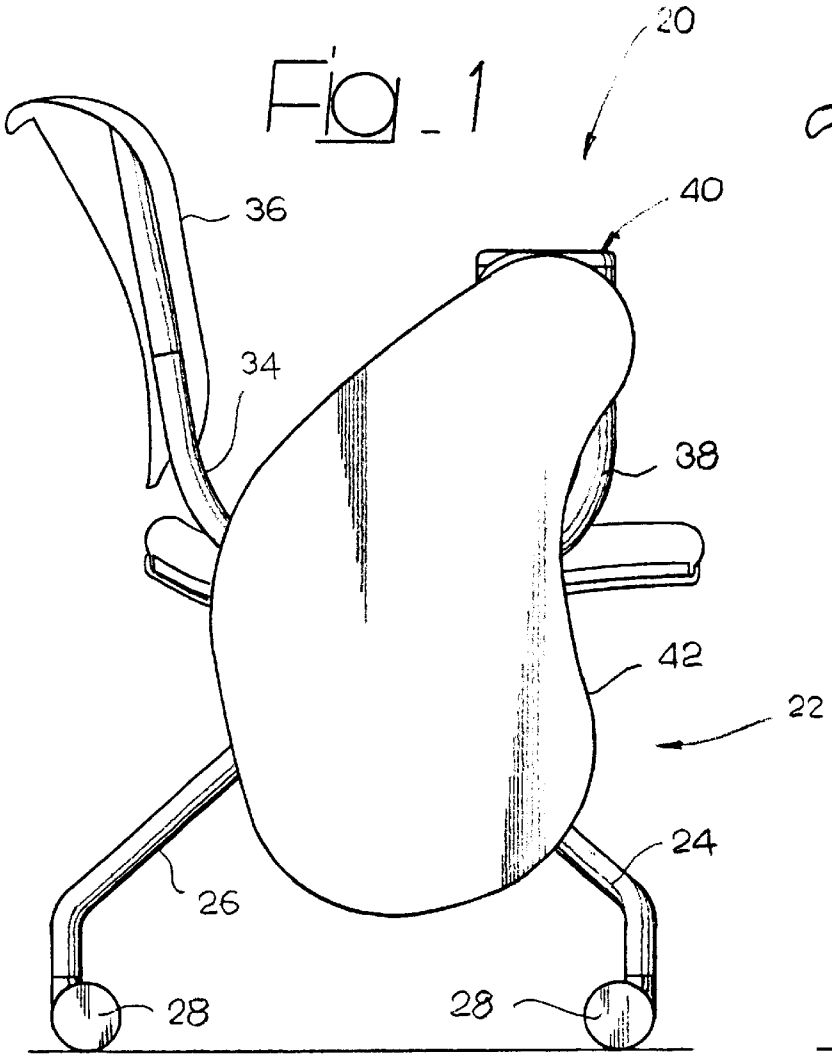
FIG. 1 is a side view of a chair according to the invention, with the writing table in the lowered position.

With reference to FIGS. 1 to 4, the reference number 20 designates a chair comprising a base structure 22, which includes a pair of front legs 24 and a pair of rear legs 26, each of said legs carrying at its bottom end a wheel 28, preferably of an orientable type. The base structure 22 comprises a transverse element 30, about which there is mounted, so that it can turn, a seat 32, which can move between a raised, inoperative, position, and a lowered, operative, position. A supporting structure for supporting the backrest 34 is mounted on the transverse element 30 in an oscillating way and co-operates with elastic means (not illustrated) which counter the action of backward thrust exerted by the occupant against the backrest 36.

Figures 3, 4:
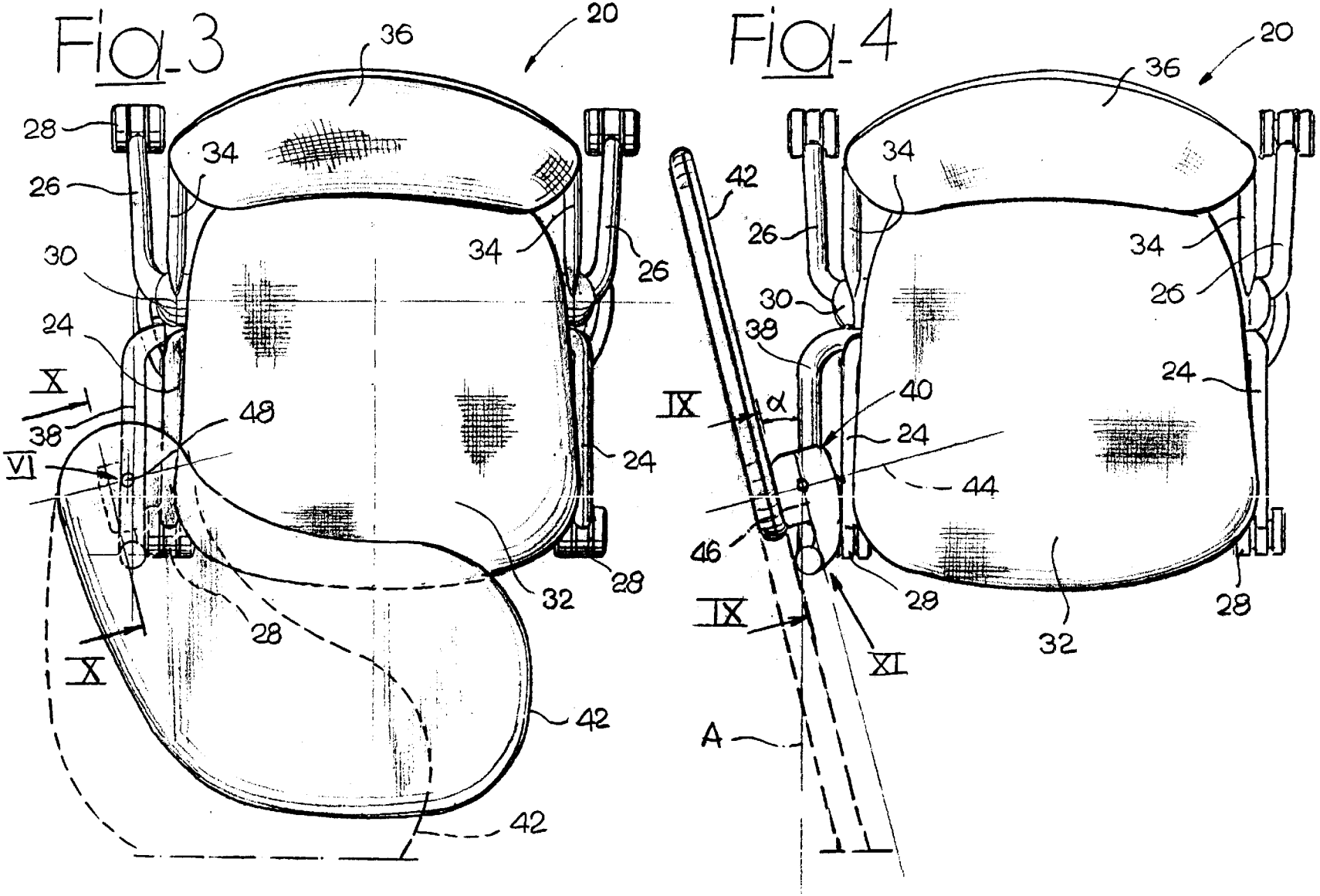
FIGS. 3 and 4 are plan views of the chair according to the invention, with the writing table in the raised position and in the lowered position, respectively.
Figure 5:
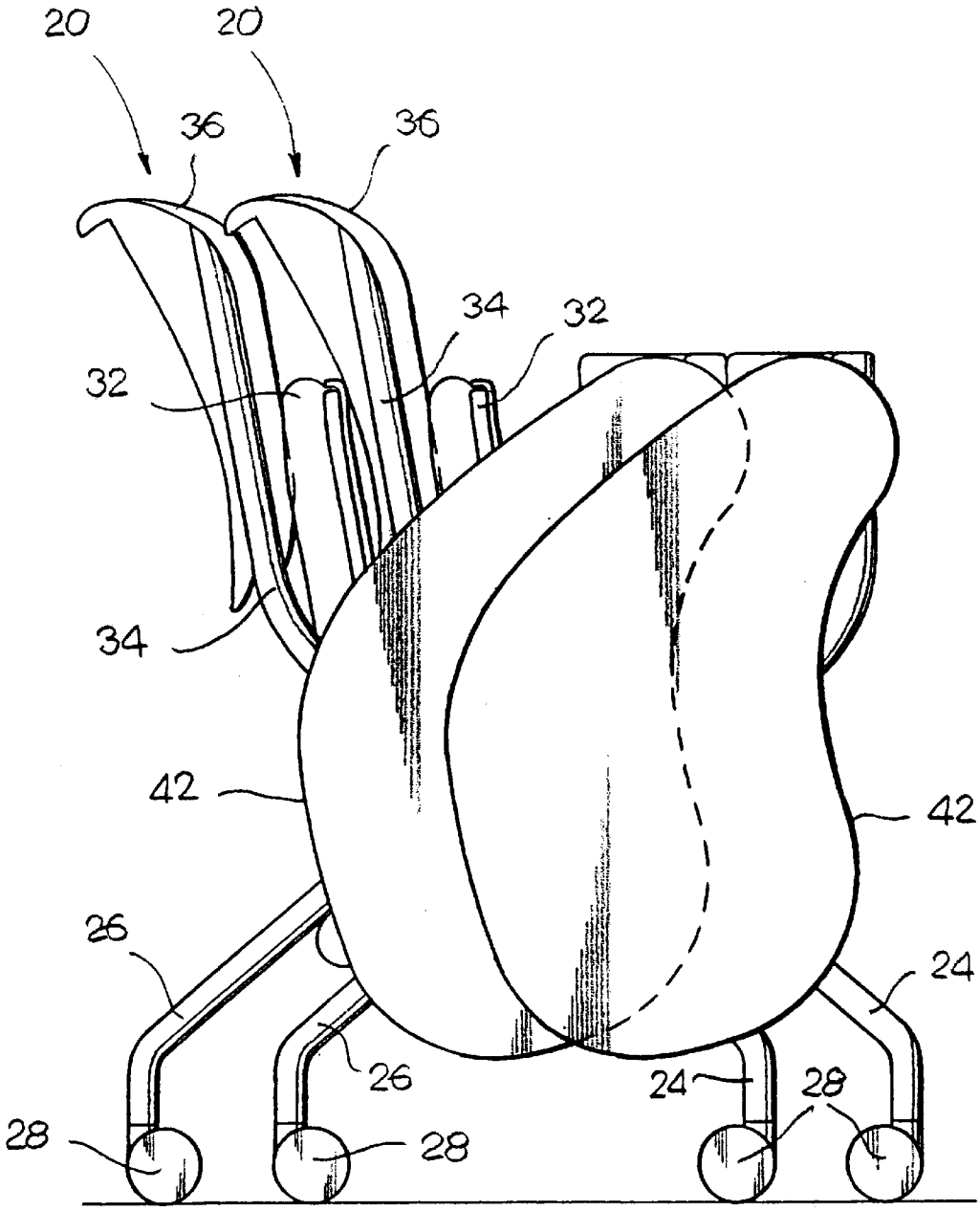
FIG. 5 is a side view illustrating two chairs according to the invention, which are slid into one another in a longitudinal direction.

The base structure 22 comprises a tubular supporting element 38, which carries, at its top, an articulation element 40, to which there is connected, in the way described in what follows, a writing table 42. The table 42 can move between a lowered, inoperative, position, illustrated in FIGS. 1 and 4, and a raised, operative, position, illustrated in FIGS. 2 and 3. According to the present invention, in the lowered, inoperative, position, the writing table 42 is inclined by an angle $\alpha$ with respect to a vertical plane A parallel to a longitudinal plane of symmetry of the chair 20. The angle $\alpha$ is an acute angle, preferably of between 5° and 20°, for example approximately 14°. The above arrangement of the writing table 42 enables two or more chairs of the same type to slide into one another in the longitudinal direction, as illustrated in FIG. 5. To make it possible for the chairs 20 to slide into one another, it is necessary for the external legs 24 and the internal legs 26 to be staggered with respect to one another in a transverse direction, as illustrated in FIGS. 3 and 4, so that, when two chairs slide into one another, the front legs 24 of the chair located in the rear position pass between the rear legs 26 of the front chair that is immediately adjacent to it. As illustrated in FIG. 5, in the position where one set of chairs 20 of the same type are slid into one another, the seat 32 of each chair is raised in a substantially vertical position, so that the backrest 36 of the chair set in front is substantially adjacent to the transverse element 30 of the chair that is in a position immediately behind it.

With reference to FIG. 4, the articulation mechanism 40 is built in such a way as to enable two movements of rotation about the two mutually orthogonal axes 44, 46. The first axis of rotation 44 is orthogonal to the plane of the writing table 42, whilst the second axis of rotation 46 is parallel to the plane of the writing table 42. To pass from the inoperative position of FIG. 1 to the operative position of FIG. 2, it is necessary first to make a rotation about the axis 44 and then a rotation about the axis 46. With reference to FIG. 3, when the table is in the raised, operative, position, the articulation mechanism 40 enables a further movement of oscillation of the table 42 about a vertical axis 48 orthogonal to the plane of representation of FIG. 3. This movement of rotation about the axis 48 enables the table 42 to be displaced between the position indicated by the solid line and the position indicated by the dashed line. This movement is advantageous for enabling the user to get up from the chair without having to lower the table 42. Consequently, the user can get up from the chair without having to remove any objects that may be resting on the surface of the table 42.

Figure 12:
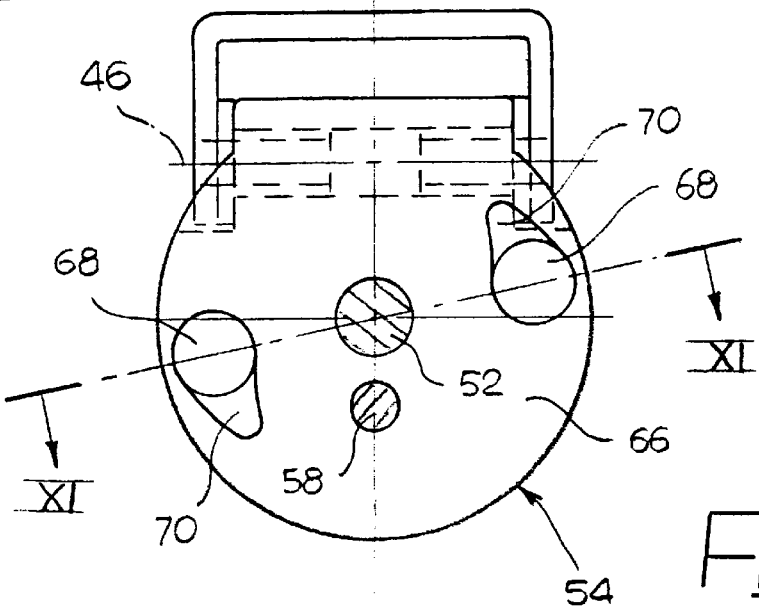
Figure 11:
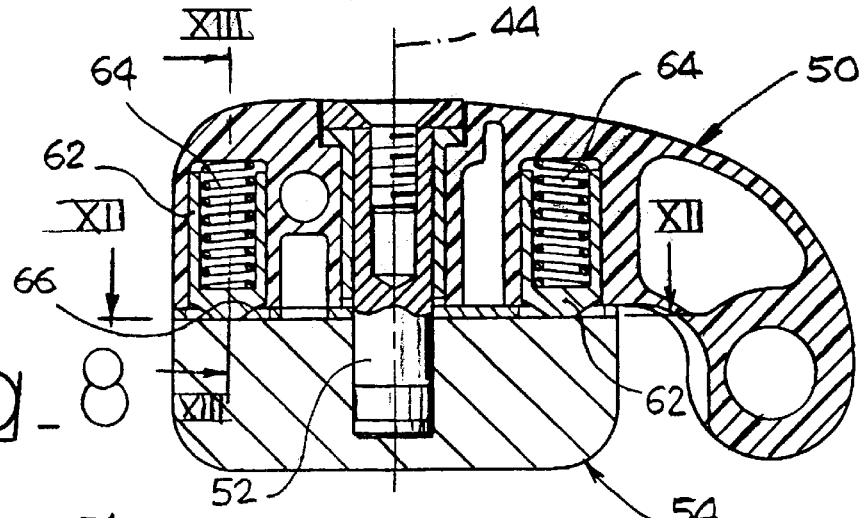
FIG. 11 is a cross-sectional plan view of the part indicated by the arrow XI in FIG. 4.

The constructional characteristics of the articulation mechanism 40, which enable the movements about the axes 44, 46, and 48 to be obtained, will be described in what follows with reference to FIGS. 6 to 14. With initial reference to FIGS. 11 to 14, the articulation mechanism 40 comprises a base body 50 fixed at the top of the tubular support 38 forming part of the base structure 22 of the chair. The base body 50 carries a pin 52, the axis of which defines the first axis of rotation 44. A rotating body 54 is mounted so that it can turn about the pin 52. With reference to FIGS. 14 and 15, the body 50 has an arched groove 56 with an angular extension of approximately 180°, within which an end stretch of a pin 58 carried by the rotating body 54 engages with play. The ends of the arched groove 56 define the limit positions of end of travel of the rotating body 54 with respect to the base body 50. Preferably, in a position corresponding to one of the ends of the arched groove 56, there is positioned a wad of elastomeric material 60. With reference to FIGS. 11, 12, and 13, a spring-type retention mechanism is set between the basic body 50 and the rotating body 54, in order to withhold the rotating body 54 in a stable position corresponding to the lowered position of the table. The said retention mechanism comprises a pair of pins 62, slidably mounted within respective seats of the base body 50 and pushed by springs 64 in compression against a front surface 66 of the rotating body 54. On the surface 66 of the rotating body 54, a pair of engagement seats 68 are formed with a part 70 shaped like a ramp, within which end portions of the pins 62 engage, as illustrated in FIG. 13, in order to withhold the body 54 in the stable retention position.

Figure 6:
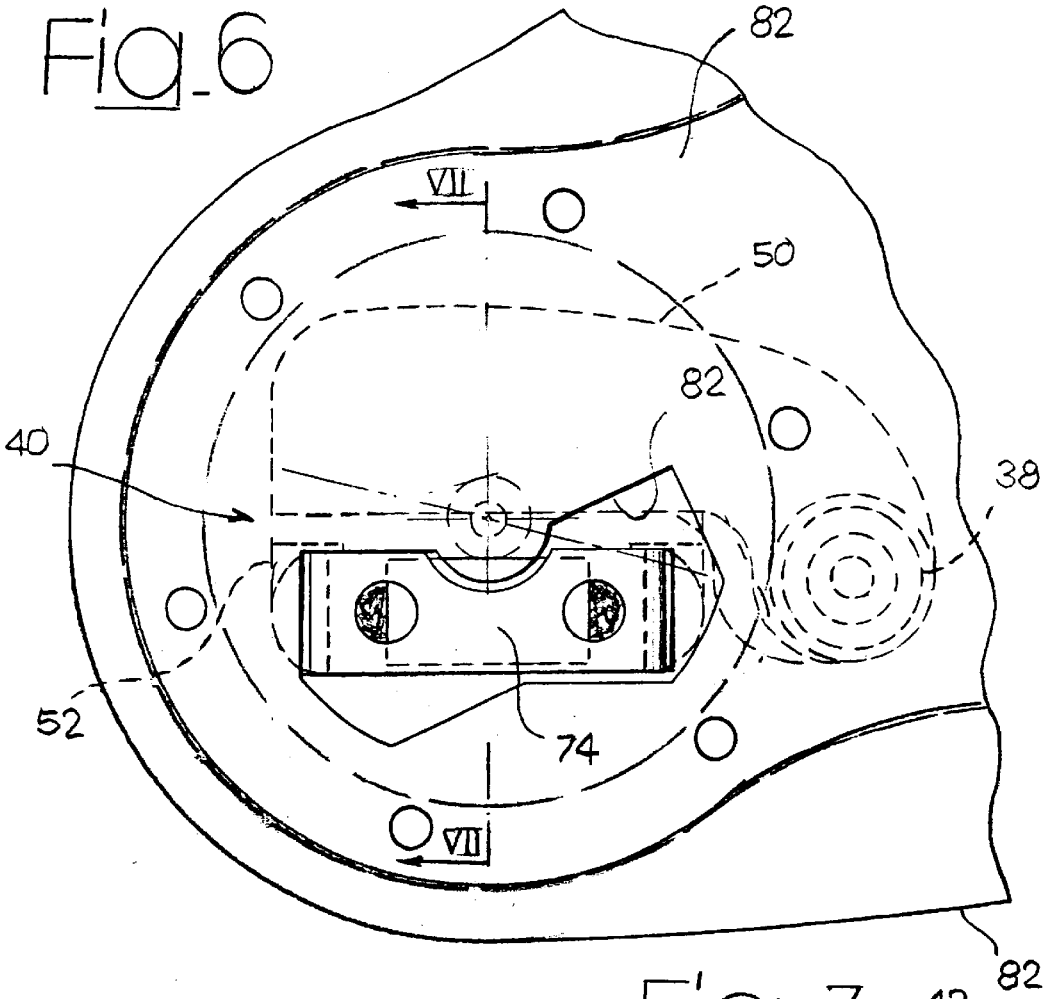
FIG. 6 is a plan view of the part indicated by the arrow VI in FIG. 3.
Figure 7:
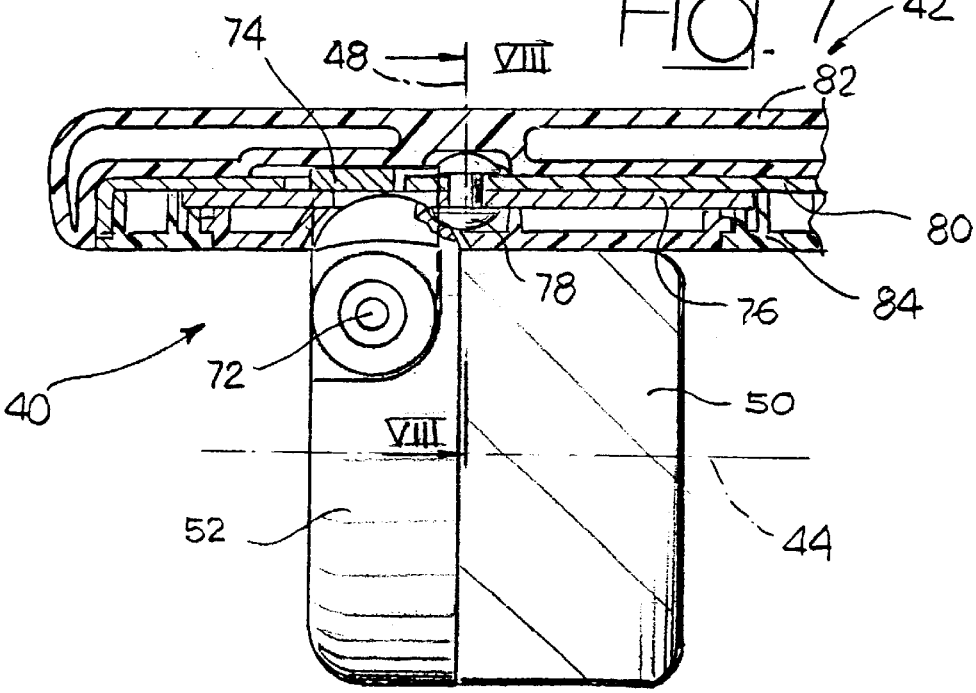
FIG. 7 is a cross section taken along the line VII—VII of FIG. 6.
Figure 8:
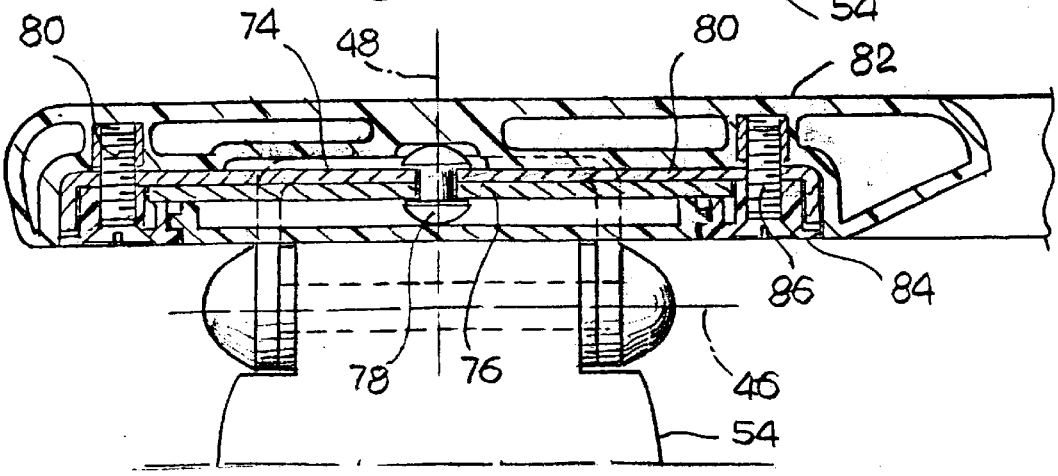
FIG. 8 is a cross section taken along the line VIII—VIII of FIG. 7.
Figure 9:
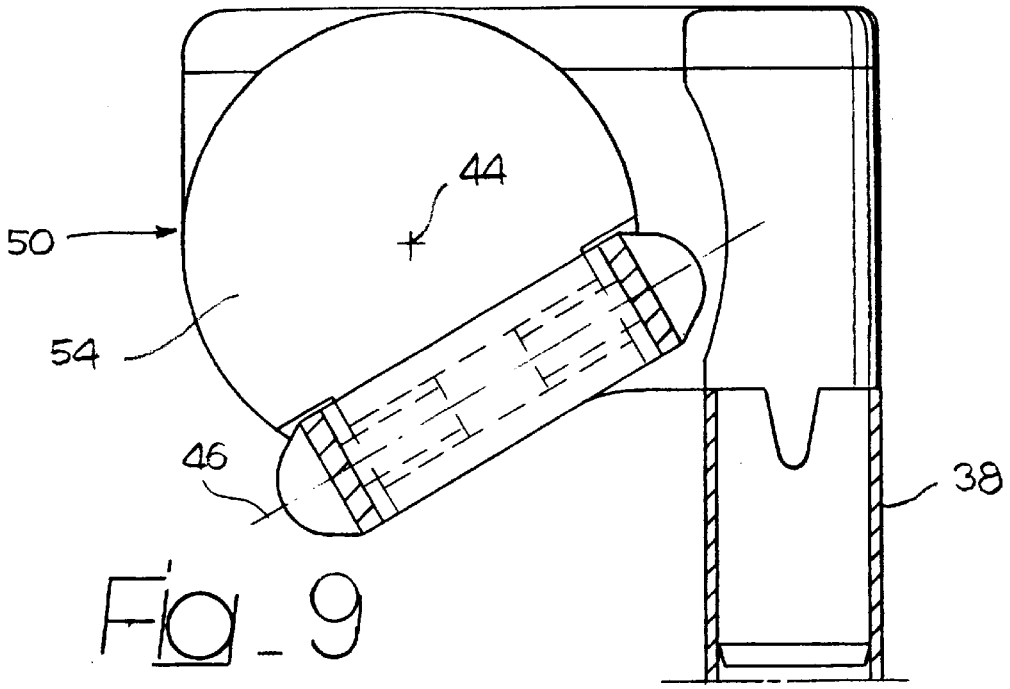
FIGS. 9 and 10 are cross sections taken, respectively, along the lines IX—IX of FIG. 4 and X—X of FIG. 3.
Figure 10:
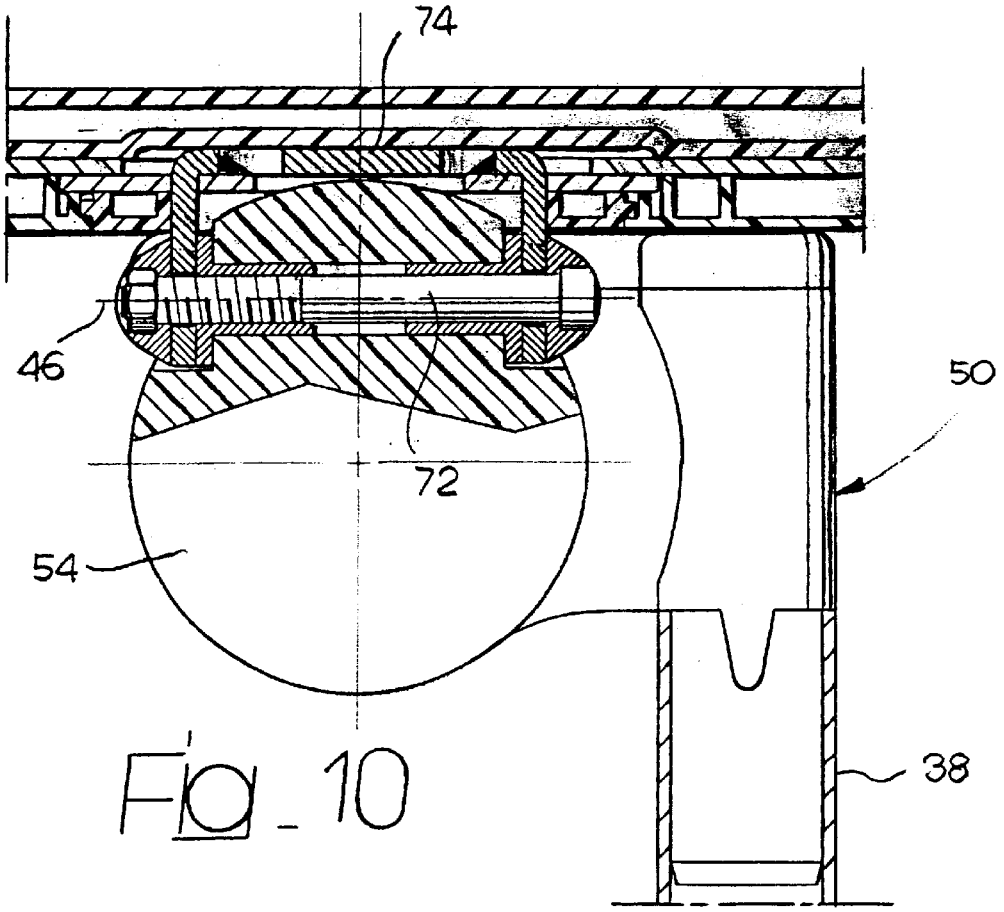

With reference to FIGS. 8, 9, and 10, the rotating body 54 carries a pin 72, which defines the second axis of oscillation 46. Articulated on the pin 72 is a U-shaped bracket 74, which is able to perform an oscillation with an amplitude of approximately 90° about the pin 72. With reference to FIGS. 7, 8, and 10, the U-shaped bracket 74 is fixed to a disk 76, which carries a pivot pin 78 defining the third axis of oscillation 48. A metal plate 80, which forms the supporting structure of the writing table 42, is mounted so that it can turn about the pin 78. With reference to FIG. 6, the metal plate 80 has a shaped opening 82, the walls of which co-operate with the U-shaped bracket 74 to define two end-of-travel positions of oscillation of the table 42, which correspond to the positions illustrated in FIG. 3 with a solid line and with a dashed line. Shells made of plastic material 82, 84, forming the outer part of the writing table 42, are fixed to the plate 80 by means of screws designated by 86 in FIG. 8.

Of course, without prejudice to the principle of the invention, the details of construction and the embodiments may vary widely with respect to what is described and illustrated herein, without thereby departing from the scope of the present invention as defined in the ensuing claims.

What is claimed is:

1. A chair comprising a base structure bearing a seat, backrest, and a writing table which can be moved between an inoperative position, and an operative position, wherein in the said inoperative position, the plane of table is parallel with respect to a vertical axis and is inclined with respect to a vertical plane parallel to the longitudinal plane of symmetry of the chair, in such a way that two or more chairs of the same type can be set longitudinally against one another, with the tables of two adjacent chairs partially overlapping one another.

2. The chair according to claim 1, wherein the angle formed between the plane of the writing table and the aforesaid vertical plane is between 5° and 20°.

3. The chair according to claim 1, wherein the writing table is carried by an articulation mechanism, which enables the table to rotate between a lower position and an upper position about an axis inclined with respect to the aforesaid vertical plane.

4. The chair according to claim 3, wherein, in the operative position, the articulation mechanism enables the table to oscillate about a vertical axis between two alternative operative positions.

5. The chair according to claim 3, wherein the articulation mechanism comprises retention means designed to hold the table in a stable retention position corresponding to the inoperative position.

6. The chair according to claim 4, wherein the articulation mechanism comprises end-of-travel means defining two end-of-travel positions for the movement of oscillation of the table about said vertical axis.

* * * * *